US007357450B2

(12) United States Patent
Rogers

(10) Patent No.: US 7,357,450 B2
(45) Date of Patent: Apr. 15, 2008

(54) WALL-AVOIDING HIGH LEG RECLINER CHAIR

(75) Inventor: W. Clark Rogers, Denton, NC (US)

(73) Assignee: M & M Frame Co., Inc., Denton, NC (US)

( * ) Notice: Subject to any disclaimer, the term of this patent is extended or adjusted under 35 U.S.C. 154(b) by 25 days.

(21) Appl. No.: 11/378,056

(22) Filed: Mar. 17, 2006

(65) Prior Publication Data

US 2006/0249993 A1 Nov. 9, 2006

Related U.S. Application Data

(60) Provisional application No. 60/675,307, filed on Apr. 27, 2005.

(51) Int. Cl.
*A47C 1/035* (2006.01)
*A47C 1/02* (2006.01)
*A47C 1/024* (2006.01)

(52) U.S. Cl. ..... 297/68; 297/83; 297/84; 297/85

(58) Field of Classification Search ..... 297/68, 297/69, 70, 83, 84, 85
See application file for complete search history.

(56) References Cited

U.S. PATENT DOCUMENTS 3,730,585 A * 5/1973 Rogers et al. ..... 297/85
3,758,151 A * 9/1973 Re ..... 297/83
3,819,229 A * 6/1974 Rogers et al. ..... 297/84
3,880,462 A * 4/1975 Mednick ..... 297/84
4,071,275 A * 1/1978 Rogers, Jr. ..... 297/85
4,128,273 A * 12/1978 Jones ..... 297/84
4,185,869 A * 1/1980 Rogers, Jr. ..... 297/84
4,185,870 A * 1/1980 Johnson ..... 297/84
4,188,062 A * 2/1980 Rogers, Jr. et al. ..... 297/85
4,212,495 A * 7/1980 Gall ..... 297/84
4,249,772 A * 2/1981 Rogers, Jr. ..... 297/85
4,291,913 A * 9/1981 Kowalski ..... 297/68
4,350,387 A * 9/1982 Rogers, Jr. ..... 297/85
4,352,523 A * 10/1982 Holobaugh, Jr. ..... 297/85
4,365,836 A * 12/1982 Jackson et al. ..... 297/85
4,519,647 A * 5/1985 Rogers, Jr. ..... 297/85
4,740,031 A * 4/1988 Rogers, Jr. ..... 297/85

(Continued)

*Primary Examiner*—Rodney B. White
(74) *Attorney, Agent, or Firm*—Myers Bigel Sibley & Sajovec

(57) ABSTRACT

A reclining seating unit includes: a base; a generally horizontally disposed seat positioned above the base; a generally upright backrest positioned above a rear portion of the seat; an ottoman; and a reclining mechanism attached to the base, seat, backrest and ottoman. The reclining mechanism comprises a series of pivotally interconnected links and is configured to move the chair between an upright position, in which the ottoman is positioned below the seat and the backrest and seat form a first angle, a TV position, in which the ottoman is generally horizontally disposed in front of the seat, the seat and backrest move forwardly relative to the base, and the backrest and seat substantially maintain the first angle, and a fully reclined position, in which the seat and backrest form a second angle that is greater than the first angle, and the seat moves further forwardly relative to the base. In the closed position, the links of the mechanism extend downwardly from the seat less than about 7 inches. In this configuration, the mechanism can be used with typical "high-leg" chairs while being substantially hidden from view when the chair is in the upright position.

10 Claims, 6 Drawing Sheets

U.S. PATENT DOCUMENTS

| | | | | | |
|---|---|---|---|---|---|
| 4,805,960 | A | * | 2/1989 | Tacker | 297/85 |
| 4,815,788 | A | * | 3/1989 | May | 297/68 |
| 4,878,710 | A | * | 11/1989 | Tacker | 297/68 |
| 4,904,019 | A | * | 2/1990 | May | 297/85 |
| 4,989,914 | A | * | 2/1991 | Pine | 297/85 |
| RE33,704 | E | * | 10/1991 | Rogers, Jr. | 297/85 |
| 5,072,988 | A | * | 12/1991 | Plunk | 297/68 |
| 5,147,108 | A | * | 9/1992 | LaPointe | 297/85 |
| 5,156,441 | A | * | 10/1992 | Byersmith et al. | 297/68 |
| 5,271,660 | A | * | 12/1993 | LaPointe et al. | 297/85 |
| 5,292,170 | A | * | 3/1994 | LaPointe et al. | 297/85 |
| RE34,666 | E | * | 7/1994 | Tacker | 297/85 |
| 5,427,431 | A | * | 6/1995 | Saul et al. | 297/85 |
| 5,480,209 | A | * | 1/1996 | May | 297/85 |
| 5,588,710 | A | * | 12/1996 | Wiecek | 297/85 |
| 5,772,278 | A | * | 6/1998 | Kowalski | 297/85 |
| 5,823,614 | A | * | 10/1998 | Johnson et al. | 297/85 |
| 5,975,627 | A | * | 11/1999 | LaPointe et al. | 297/68 |
| 5,992,930 | A | * | 11/1999 | LaPointe et al. | 297/68 |
| 6,135,559 | A | * | 10/2000 | Kowalski | 297/68 |
| 6,145,924 | A | * | 11/2000 | Mero et al. | 297/68 |
| 6,409,262 | B1 | * | 6/2002 | LaPointe | 297/68 |
| 7,261,367 | B2 | * | 8/2007 | Duncan et al. | 297/68 |

* cited by examiner

WALL-AVOIDING HIGH LEG RECLINER CHAIR

RELATED APPLICATION

This application claims priority from U.S. Provisional Patent Application Ser. No. 60/675,307, filed Apr. 27, 2005, the disclosure of which is hereby incorporated herein in its entirety.

BACKGROUND OF THE INVENTION

Conventionally, a recliner chair will move from an upright position, in which the backrest is generally upright, to one or more reclined positions, in which the backrest pivots to be less upright. The movement of the seating unit between the upright and reclined positions is typically controlled by a pair of synchronized reclining mechanisms that are attached to the seat, backrest and base of the chair. Many recliners will have an extendable footrest or ottoman that provides support for the occupant's feet in the reclined position.

One particularly popular recliner is the "three-way" recliner, which has two reclined positions: a "TV position", in which the footrest or ottoman of the chair is projected forwardly from the chair while the backrest remains substantially upright and at substantially the same angle relative to the seat as in the upright position; and a "fully reclined position", in which the backrest is less upright (ie., it has been reclined to a shallower angle relative to the floor). In a "three-way" recliner, the backrest pivots relative to the seat as the chair takes its fully reclined position; this differs from a "two-way" recliner, in which the backrest and seat are rigidly fixed and do not pivot relative to one another as the chair moves to the fully reclined position.

Many recliner chairs, particularly older models, have been rather bulky. In many instances the bulk of the chair was necessary to cover the reclining mechanism when the chair was in the upright position. However, in some instances it has now become desirable to incorporate a slimmer, sleeker look into furniture, so designers of recliner chairs have responded with designs intended to present a more contemporary look. For example, U.S. Pat. No. 4,915,444 to Rogers, Jr. illustrates a three-way recliner with a "wrap-around" upholstery layer. The upholstery layer is attached at one end to the rear portion of the seat and at its other end to the front end of the footrest. In the upright position, the footrest folds under the front portion of the seat in a generally horizontal disposition, such that the upholstery layer covers the upper surface of the seat, the lower surface of the footrest, and the front surface of the chair between the seat and the footrest. As another example, U.S. Pat. No. 6,540,291 to Hoffman illustrates a contemporary "off-the-floor" style chair with three-way reclining capability.

The ability of a recliner chair to be placed with its backrest near a wall, such that it can move to the reclined positions while still avoiding the wall, can also be a desirable feature. Exemplary "wall-avoiding" chairs are illustrated and described in U.S. Pat. No. 4,337,977 to Rogers et al., U.S. Pat. No. 4,249,772 to Rogers, and U.S. Pat. No. 4,418,957 to Rogers, the disclosures of each of which are hereby incorporated herein in their entireties. Typically "wall-proximity" or "wall-avoiding" seating units can be positioned so that the backrest is within about 3 inches of an adjacent wall in the upright position. This is typically achieved by including structure that enables the seat and backrest to move forwardly relative to the base as the chair moves to the TV and reclined positions.

It may be desirable to provide a recliner chair with wall-avoiding capability for additional styles of chairs, including so-called "high-leg" chairs.

SUMMARY OF THE INVENTION

As a first aspect, embodiments of the present invention are directed to a reclining seating unit, comprising: a base; a generally horizontally disposed seat positioned above the base; a generally upright backrest positioned above a rear portion of the seat; an ottoman, and a reclining mechanism attached to the base, seat, backrest and ottoman. The reclining mechanism comprises a series of pivotally interconnected links and is configured to move the chair between an upright position, in which the ottoman is positioned below the seat and the backrest and seat form a first angle, a TV position, in which the ottoman is generally horizontally disposed in front of the seat, the seat and backrest move forwardly relative to the base, and the backrest and seat substantially maintain the first angle, and a fully reclined position, in which the seat and backrest form a second angle that is greater than the first angle, and the seat moves further forwardly relative to the base. In the closed position, the links of the mechanism extend downwardly from the seat less than about 7 inches. In this configuration, the mechanism can be used with typical "high-leg" chairs while being substantially hidden from view when the chair is in the upright position.

As a second aspect, embodiments of the present invention are directed to a reclining seating unit, comprising: a base; a generally horizontally disposed seat positioned above the base; a generally upright backrest positioned above a rear portion of the seat; a first ottoman; and a reclining mechanism attached to the base, seat, backrest and first ottoman. The reclining mechanism comprises a series of pivotally interconnected links and is configured to move the chair between an upright position, in which the first ottoman is positioned below the seat and is generally horizontally disposed and the backrest and seat form a first angle, a TV position, in which the first ottoman is generally horizontally disposed in front of the seat, the seat and backrest move forwardly relative to the base, and the backrest and seat substantially maintain the first angle, and a fully reclined position, in which the seat and backrest form a second angle that is greater than the first angle. The reclining mechanism includes: first and second ottoman drive links pivotally interconnected with the seat; an outer ottoman extension link pivotally interconnected with the first and second ottoman drive links; an inner ottoman extension link pivotally interconnected with the second ottoman drive link; an ottoman control link pivotally interconnected with the outer ottoman extension link and with the inner ottoman extension link; and an outer ottoman bracket on which is mounted the first ottoman. The outer ottoman bracket is pivotally and slidably interconnected with the inner ottoman extension link and pivotally interconnected with the outer ottoman extension link. This configuration can enable the ottoman to be obscured from view in the upright position, yet still travel to an appropriate location forward of the seat in the TV position.

As a third aspect, embodiments of the present invention are directed to a reclining seating unit, comprising: a base; a generally horizontally disposed seat positioned above the base; a generally upright backrest positioned above a rear portion of the seat; an ottoman; and a reclining mechanism attached to the base, seat, backrest and ottoman. The reclining mechanism comprises a series of pivotally interconnected links and is configured to move the chair between an upright position, in which the ottoman is positioned below the seat and the backrest and seat form a first angle, a TV position, in which the ottoman is generally horizontally disposed in front of the seat, the seat and backrest move forwardly relative to the base, and the backrest and seat substantially maintain the first angle, and a fully reclined position, in which the seat and backrest form a second angle that is greater than the first angle. The reclining mechanism includes an actuation assembly, the actuation assembly including a handle rotatably mounted relative to the seat about a transverse axis, a drive link fixed relative to the handle, a reaction link pivotally attached to the drive link at a first pivot. The reclining mechanism futher includes a first ottoman drive link pivotally interconnected with the seat at a second pivot. In the TV position, the first and second pivots are closely adjacent to each other, with the first pivot positioned slightly forward of the second pivot.

As a fourth aspect, embodiments of the present invention are directed to a reclining seating unit, comprising: a base; a generally horizontally disposed seat positioned above the base; a generally upright backrest positioned above a rear portion of the seat; an ottoman; and a reclining mechanism attached to the base, seat, backrest and ottoman. The reclining mechanism comprises a series of pivotally interconnected links and is configured to move the chair between an upright position, in which the ottoman is positioned below the seat and the backrest and seat form a first angle, a TV position, in which the ottoman is generally horizontally disposed in front of the seat, the seat and backrest move forwardly relative to the base, and the backrest and seat substantially maintain the first angle, and a fully reclined position, in which the seat and backrest form a second angle that is greater than the first angle, and the seat moves further forwardly relative to the base. The reclining mechanism further includes a support link pivotally interconnected to the base at a first pivot, a rear swing link pivotally interconnected to the support link at a second pivot, and a control link pivotally interconnected to the base at a third pivot and to the rear swing link at a fourth pivot. In the fully reclined position, the second and fourth pivots are positioned below the first and third pivots. This configuration can enable the portion of the mechanism that controls forward movement of the seat and backrest relative to the base to be obscured from view in the upright position.

As a fifth aspect, embodiments of the present invention are directed to a reclining seating unit comprising: a base; a generally horizontally disposed seat positioned above the base; a generally upright backrest positioned above a rear portion of the seat; an ottoman; and a reclining mechanism attached to the base, seat, backrest and ottoman. The reclining mechanism comprises a series of pivotally interconnected links and is configured to move the chair between an upright position, in which the ottoman is positioned below the seat and the backrest and seat form a first angle, a TV position, in which the ottoman is generally horizontally disposed in front of the seat, the seat and backrest move forwardly relative to the base, and the backrest and seat substantially maintain the first angle, and a fully reclined position, in which the seat and backrest form a second angle that is greater than the first angle, and the seat moves further forwardly relative to the base. The reclining mechanism further includes a backpost fixed to the backrest and pivotally interconnected with the seat, a drive link pivotally interconnected to the backpost, a regulating link pivotally connected to the drive link and with the seat, and a connecting link that is pivotally interconnected to the drive link and that is coupled with the remaining links of the reclining mechanism such that pivotal movement of the backrest to the seat when the chair moves from the TV position to the upright position drives the seat and backrest forward relative to the base.

DETAILED DESCRIPTION OF EMBODIMENTS OF THE INVENTION

Figure 1:
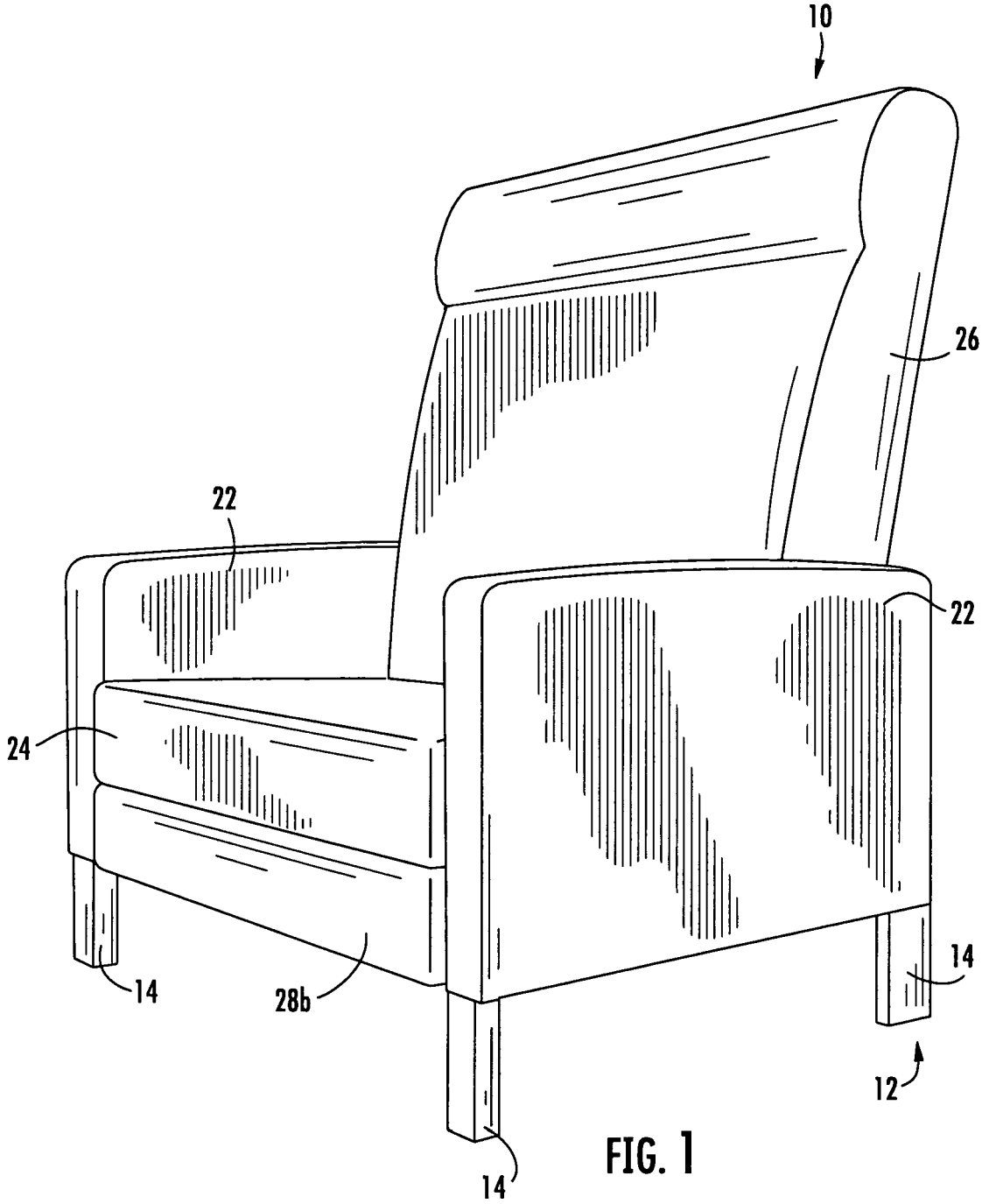
FIG. 1 is a perspective view of an embodiment of a recliner chair of the present invention, with the chair shown in the upright position

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

This invention is directed to seating units that have a stationary base, a seat, and a backrest. As used herein, the terms "forward", "forwardly", and "front" and derivatives thereof refer to the direction defined by a vector extending from the backrest toward the seat parallel to the underlying surface. Conversely, the terms "rearward", "rearwardly", and derivatives thereof refer to the direction directly opposite the forward direction; the rearward direction is defined by a vector that extends from the seat toward the backrest parallel to the underlying surface. The terms "lateral," "laterally", and derivatives thereof refer to the direction parallel with the floor, perpendicular to the forward and rearward directions, and extending away from a plane bisecting the seating units between their armrests. The terms "medial," "inward," "inboard," and derivatives thereof refer to the direction that is the converse of the lateral direction, i.e., the direction parallel with the floor, perpendicular to the forward direction, and extending from the periphery of the seating units toward the aforementioned bisecting plane.

The seating unit illustrated and described herein comprises a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4-21 (1979).

Referring now to the figures, a high leg, wall-avoiding recliner chair, designated broadly at 10, is illustrated in FIGS. 1-6. Referring first to FIG. 1, the chair 10 includes a base assembly 12 that comprises four legs 14, two side rails 15 (only one of which is visible in FIG. 2) extending longitudinally between two of the legs 14, and a rear cross rail 16 that spans the rear pair of legs 14. An arm 22 is attached to each side rail 15. The chair 10 also includes a seat 24 that is generally horizontally disposed above the base 12, a backrest 26 that is generally upright and positioned above a rear portion of the seat 24, and two ottomans 28*a*, 28*b* that can be positioned in front of the chair 10.

Figure 5:
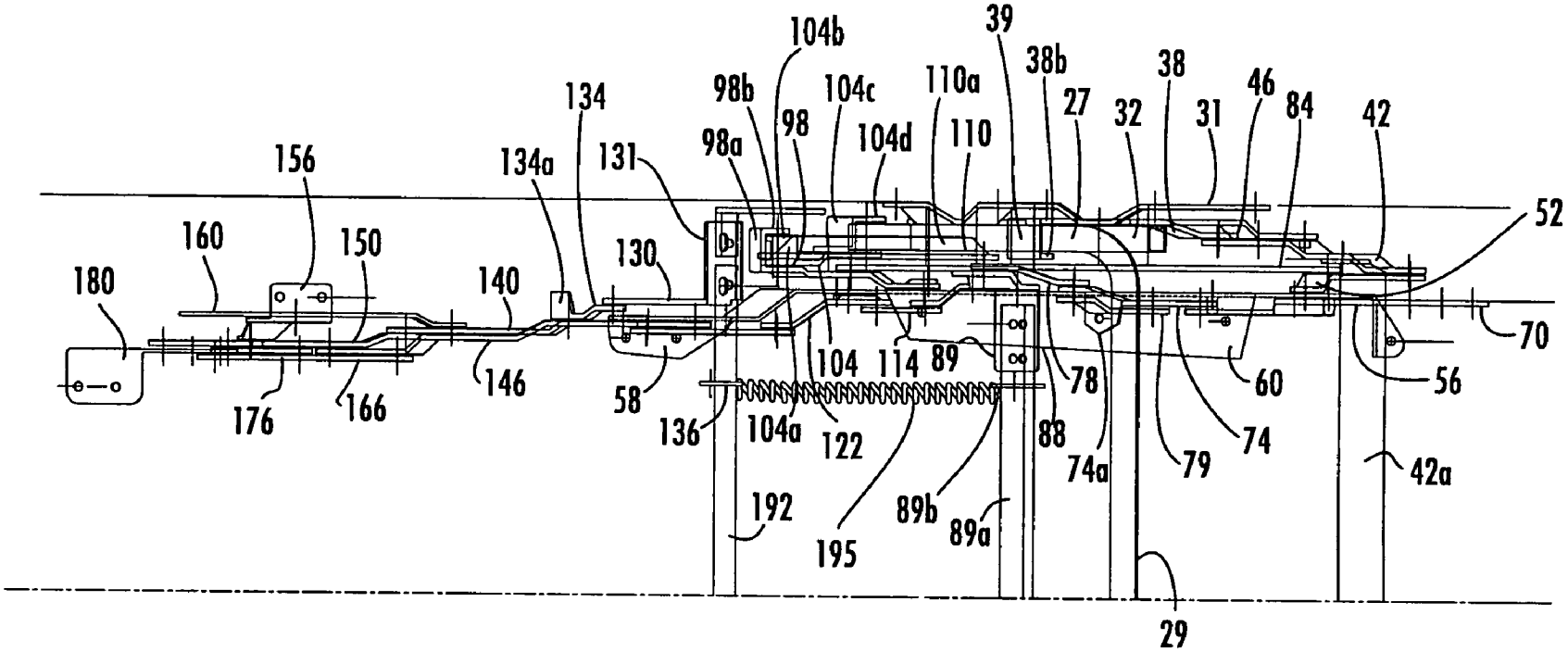
FIG. 5 is a top view of the reclining mechanism of the chair of FIG. 1 shown in the TV position.
Figure 6:
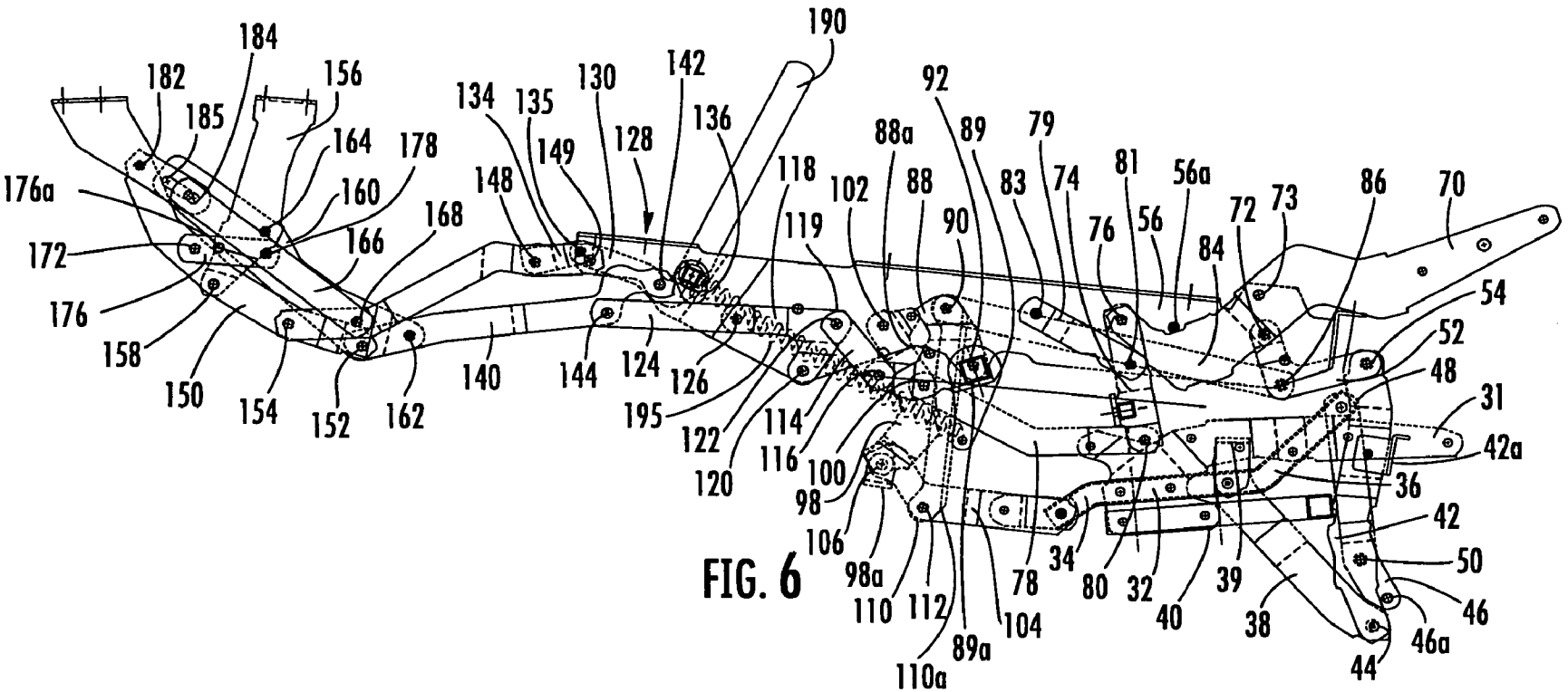
FIG. 6 is a side section view of the reclining mechanism of the chair of FIG. 1 shown in the fully reclined position.

These components are moveable relative to one another between a closed position (shown in FIGS. 1-3), a TV position (shown in FIGS. 4 and 5), and a fully reclined position (FIG. 6). Movement between these positions is controlled by two mirror image reclining mechanisms 30, one of which is shown in FIGS. 3-6. One of the reclining mechanisms 30 will be described herein in detail, with the understanding that this description is equally applicable to the other reclining mechanisms 30. The reclining mechanism 30 will be described first in the closed position of FIG. 3, then will be described as it moves to the TV and fully reclined positions of FIGS. 4 and 6.

Figure 2:
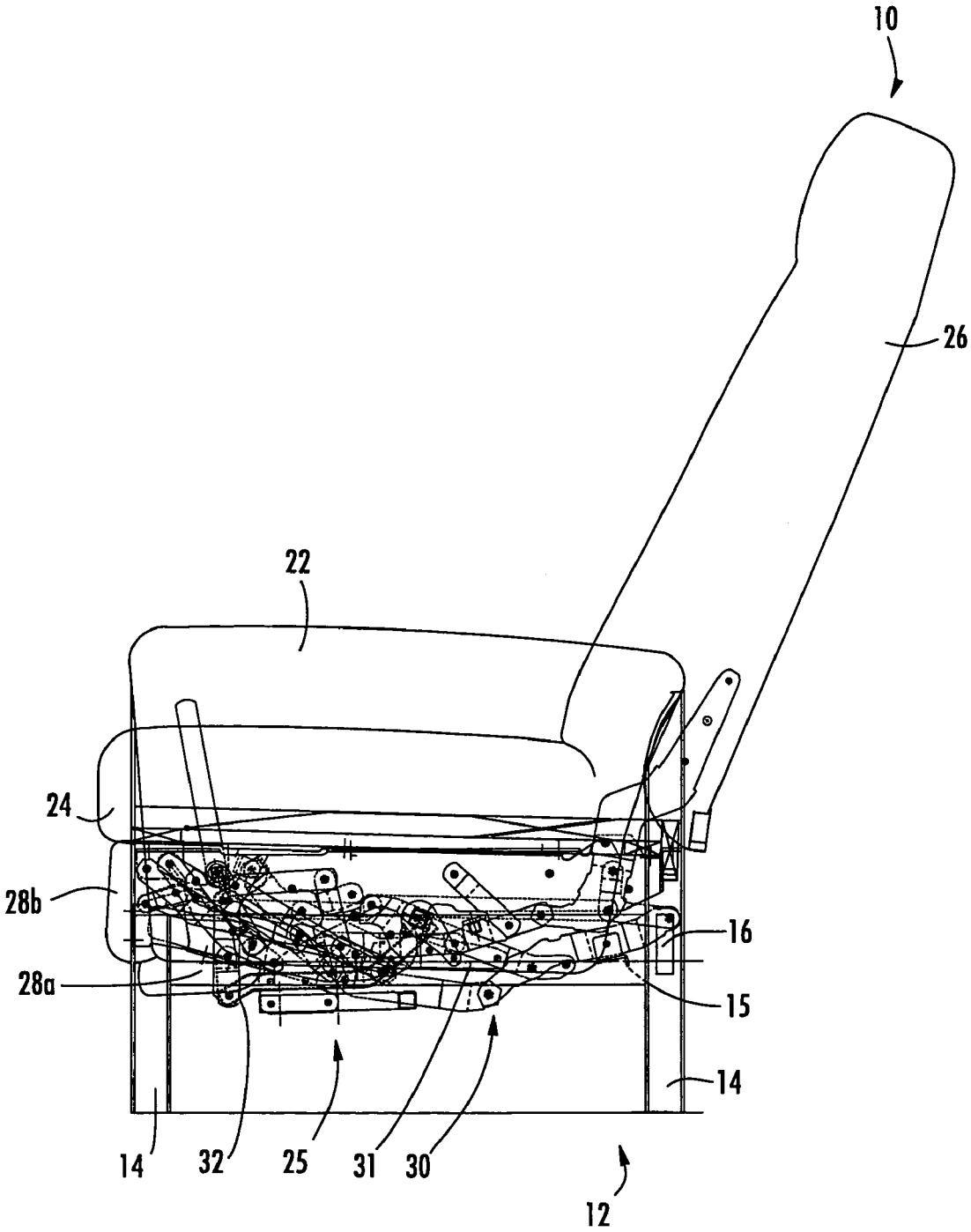
FIG. 2 is a side section view of the recliner chair of FIG. 1, with the chair shown in the upright position.
Figure 3:
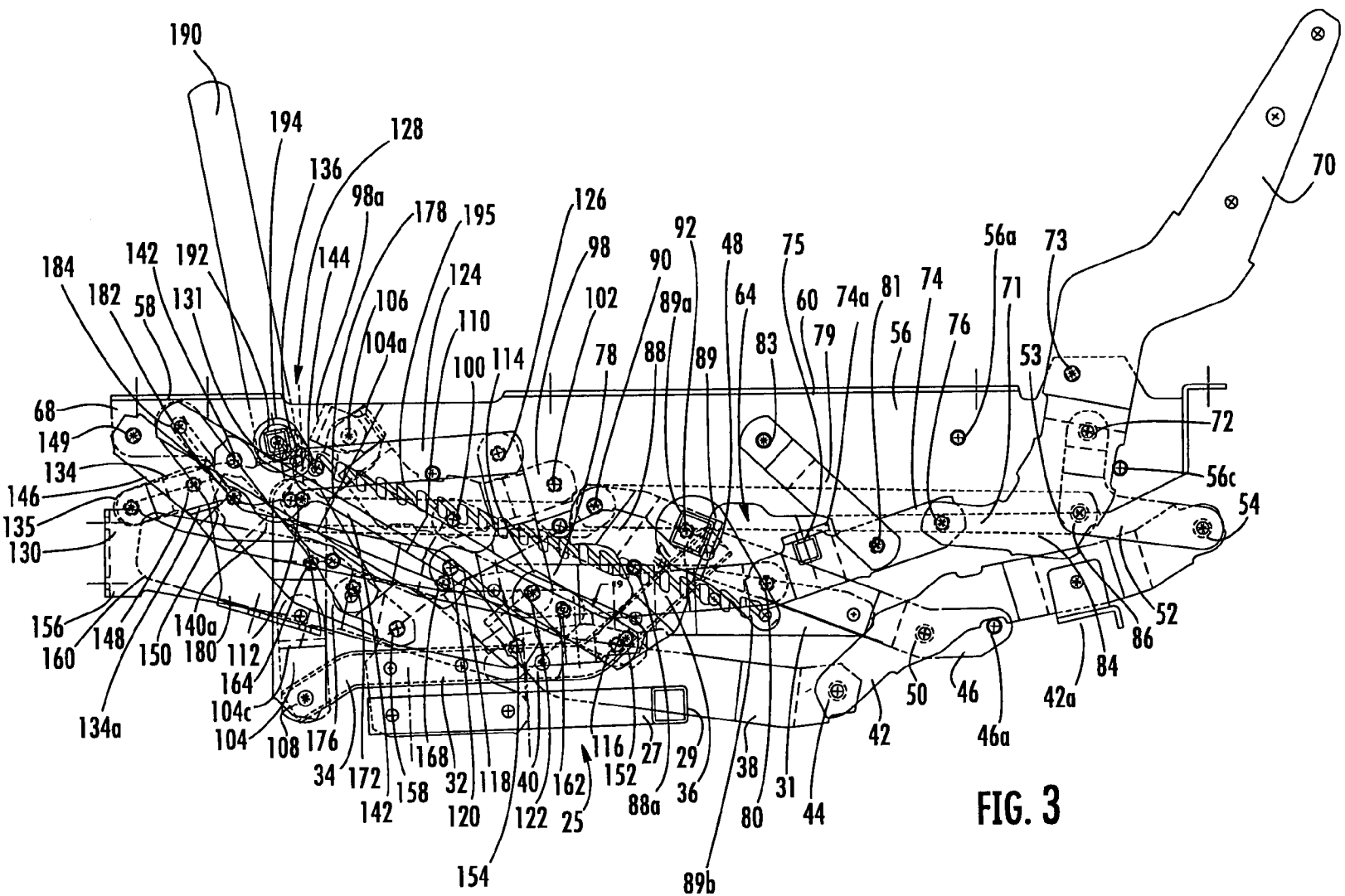
FIG. 3 is a side section view of the reclining mechanism of the chair of FIG. 1 shown in the upright position.

Turning now to FIGS. 2 and 3, the reclining mechanism 30 includes a base mounting bracket 31 that is fixed to the inner surface of an adjacent side rail 15. A base mounting tube 32 that is mounted to the inner surface of one of the base mounting bracket 31. Also, a generally U-shaped tube 25 has prongs 27 and a spanning cross-member 29; the tube 25 is positioned such that each of the prongs 27 resides below a respective base mounting tube 32 and is fixed to the inner surface of the base mounting bracket 31.

Referring now to FIGS. 2 and 3, the base mounting tube 32 has a forward finger 34 and a rear finger 36. A support link 38 is pivotally interconnected with the intermediate portion of this base mounting tube 32 at a pivot 40. A flange 39 extends upwardly from the forward end of the support link 38 and extends inwardly over the base mounting tube 32 to mate with a depending tab 38*b* that shares the pivot 40 (see FIG. 4). A slightly bent rear swing link 42 is attached to the rear end of the support link 38 at a pivot 44 and extends upwardly and rearwardly therefrom; a rear stabilizing member 42*a* extends transversely between the rear swing links 42 of each reclining mechanism 30. A control link 46 is attached to the rear finger 36 of the base mounting tube 32 at a pivot 48 and is attached at its opposite end to an intermediate portion of the rear swing link 42 at a pivot 50. A stop pin 46*a* is attached to the rear end portion of the control link 46 and contacts the underside of the rear swing link 42 when the chair 10 is in the upright position. An L-shaped drawing link 52 is attached at its rear end to the control link 42 at a pivot 54. The drawing link 52 extends forwardly from the pivot 54 to a vertex 53, then upwardly to pivotally interconnect with a seat mounting link 56 at a pivot 72 located on a rear portion thereof.

Referring still to FIGS. 2 and 3, the seat mounting link 56 extends below the seat 24 and supports it from underneath. The seat mounting link 56 includes a forward flange 58 and a rear flange 60, both of which extend inwardly. The seat mounting link 56 also includes a cutaway section 64 on its lower edge, an intermediate projection 66 (seen best in FIG. 4), also on its lower edge, a front finger 68, and a stop pin 56*a* on its inboard surface. The seat mounting link 56 provides a mounting location for a number of different components, as described below.

Referring again to FIGS. 2 and 3, a backpost 70 is pivotally interconnected at an intermediate portion thereof to the seat mounting link 56 at a pivot 73. The backrest 26 is fixed to an upper portion of the backpost 70. The lower rear edge of the backpost 70 rests against a stop pin 56*c* extending from the seat mounting link 56. A lower foot 71 of the backpost 70 extends forwardly and downwardly from the pivot 72. A short drive link 74 is connected with the lower foot 71 at a pivot 76 and extends downwardly and forwardly therefrom. A cross-member 75 is fixed to a flange 74*a* on the drive link 74 and extends transversely to the flange 74*a* on the opposite side mechanism 30. A regulating link 79 is pivotally interconnected with a central portion of the drive link 74 at a pivot 81 and to the seat mounting link 56 at a pivot 83 located above the cutaway area 64. A straight transition link 84 is pivotally attached to the drawing link 52 at a pivot 86 located at the vertex 53 thereof. The transition link 84 extends generally forwardly therefrom and terminates in a pivot 90 with forward portions of a boot-shaped control plate 88. The control plate 88 has an inwardly extending flange 89 that resides within the cutaway area 64 and an inwardly-extending stop pin 88*a*, and is pivotally interconnected at its rear corner to the seat mounting link 56 at a pivot 92 that is located just forwardly of the cutaway area 64. A cross tube 89*a* extends transversely between the flanges 89 of each of the mechanisms 30. A teardrop-shaped spring tab 89*b* extends downwardly and rearwardly from the cross tube 89*a*.

Still referring to FIGS. 2 and 3, a connecting link 78, shaped somewhat like a hockey stick, is connected to the front end of the drive link 74 at a pivot 80 and extends generally forwardly therefrom. A slightly curved upper swing link 98 is attached to the seat mounting link 56 at a pivot 102 and extends forwardly therefrom. A pivot 100 attaches the connecting link 78 to an intermediate portion of the upper swing link 98. The upper swing link 98 has a transversely-extending flange 98*a* and a downwardly extending tab 98*b* mounted to the end of the flange 98*a*. A bent lower swing link 104 also has a flange 104*a* and a downwardly extending tab 104*b*. The lower swing link 104 is attached to the forward end of the upper swing link 98 at a pivot 106 (which extends through both links 98 and both tabs 98*b*, 104*b*—best seen in FIG. 5) and extends downwardly for mounting to the forward finger 34 of the base mounting tube 32 at a pivot 108. The lower swing link 104 has an intermediate section 104*c* (seen best in FIG. 5) that extends inwardly such that the upper portion of the lower swing link 104 resides above the base mounting tube 32. A depending tab 104*d* extends from the intermediate section 104*c* and shares the pivot 108.

Referring again to FIG. 3, a flanged link 110 is attached to an intermediate portion of the lower swing link 104 at a pivot 112 and to the upper corner of the control plate 88 at the pivot 90. The flanged link 110 has an inwardly-extending flange 110*a* (FIG. 5) to provide additional rigidity for combating buckling under load. A plate connecting link 114 is attached to the forward point of the control plate 88 at a pivot 116 and extends upwardly and forwardly therefrom. An acutely angled actuator transition link 118 having a vertex 119 is attached to the plate connecting link 114 at a pivot 122. The forward leg of the actuator transition link 118 is attached to the intermediate projection 66 of the seat mounting link 56 at a pivot 120. An actuation drawing link 124 is attached to the upper leg of the actuator transition link 118 at a pivot 126 and extends forwardly therefrom.

Referring once again to FIG. 3, an actuation linkage 128 includes a drive link 130 having a flange 131 that is attached to a cross tube 192 that extends transversely between holes 194 in each seat mounting link 56. A handle 190 is fixed to the cross tube 192. The drive link 130 extends forwardly to a pivot 135 with a short reaction link 134, which extends rearwardly therefrom. The reaction link 134 includes a tab 134*a* that extends outwardly and abuts the drive link 130 from underneath to prevent the chair 10 from moving beyond the upright position. A tab 136 is fixed to the cross tube 192 inwardly of the flange 131 and extends downwardly therefrom. A spring 195 extends in tension between the tab 136 and the spring tab 89*b*.

Referring yet again to FIG. 3, a lower ottoman drive link 140 is pivotally attached at its forward end to the seat mounting link 56 at a pivot 142 and extends rearwardly and slightly downwardly therefrom. An arcuate portion 140*a* of the lower ottoman drive link 140 is positioned just below and "cups" the cross-tube 192 of the actuation linkage 128. The forward end of the actuation drawing link 124 is attached to an intermediate portion of the lower ottoman drivelink 140 at a pivot 144. A tripartite upper ottoman drive link 146 is attached at its forward end to the rear end of the reaction link 134 at a pivot 148 and to a forwardmost portion of the seat mounting link 56 at a pivot 149. In the closed position of FIG. 3, the pivots 135 and 148 and the pivot axis defined by the cross tube 192 are almost in an "over-center" condition that would lock the chair 10 in the upright position. The tension in the spring 195 urges the tab 136 counterclockwise from the vantage point of FIG. 3, which in turn urges the chair 10 to remain in the upright position.

An outer ottoman extension link 150 is attached to the rear end of the lower ottoman drive link 140 at a pivot 152 and to the rear end of the upper ottoman drive link 146 at a pivot 154 and extends forwardly therefrom. An outer ottoman bracket 156, upon which the ottoman 28*b* is mounted, is pivotally attached to the outer ottoman extension link 150 at a pivot 158, and is disposed such that the ottoman 28*b* faces forwardly. A guard 160 is pivotally attached at an intermediate portion to the outer ottoman bracket 156 at a pivot 164 and at its rear end to the lower ottoman drive link 140 at a pivot 162.

Referring again to FIG. 3, an inner ottoman extension link 166 is pivotally attached to a rear portion of the upper ottoman drive link 146 at a pivot 168 and extends forwardly and upwardly therefrom. An ottoman control link 176 is attached to an intermediate portion of the inner ottoman extension link 166 at a pivot 178 and to an intermediate portion of the outer ottoman extension link 150 at a pivot 172. A pin 176*a* extends transversely from a central portion of the ottoman control link 176. An inner ottoman bracket 180, upon which the ottoman 28*a* is mounted in an inverted fashion, is attached to the outer ottoman extension link 150 at a pivot 182 and to the inner ottoman extension link 166 via a pin 184 on the inner ottoman extension link 166 and a slot 185.

Notably, in the closed position of FIG. 3, the links that comprise the mechanism below the seat 24 are folded into a relatively small package. More specifically, the links of the reclining mechanism 30 do not extend downwardly below the forward and rear flanges 58, 60 of the seat mounting link 56 more than about 9 inches. This configuration enables the mechanism 30 to remain largely hidden from view when the chair 10 is in the closed position, even with a "high leg" style chair such as that illustrated herein. Also, the mechanism 30 is has a longitudinal dimension of less than about 26 inches, which again makes it suitable for use with a high leg style chair.

In addition, the presence of the tab 104*b* of the lower swing link 104 and of the tab 38*b* of the support link 38 helps to stabilize the mechanism 30 and can enable the chair 10 to omit cross-members between the reclining mechanisms 30 on each side of the chair 10 at these locations which might otherwise interfere with operation of the chair 10. The same is true of the flanged pivot 106 between the upper and lower front swing links 98, 104.

Figure 4:
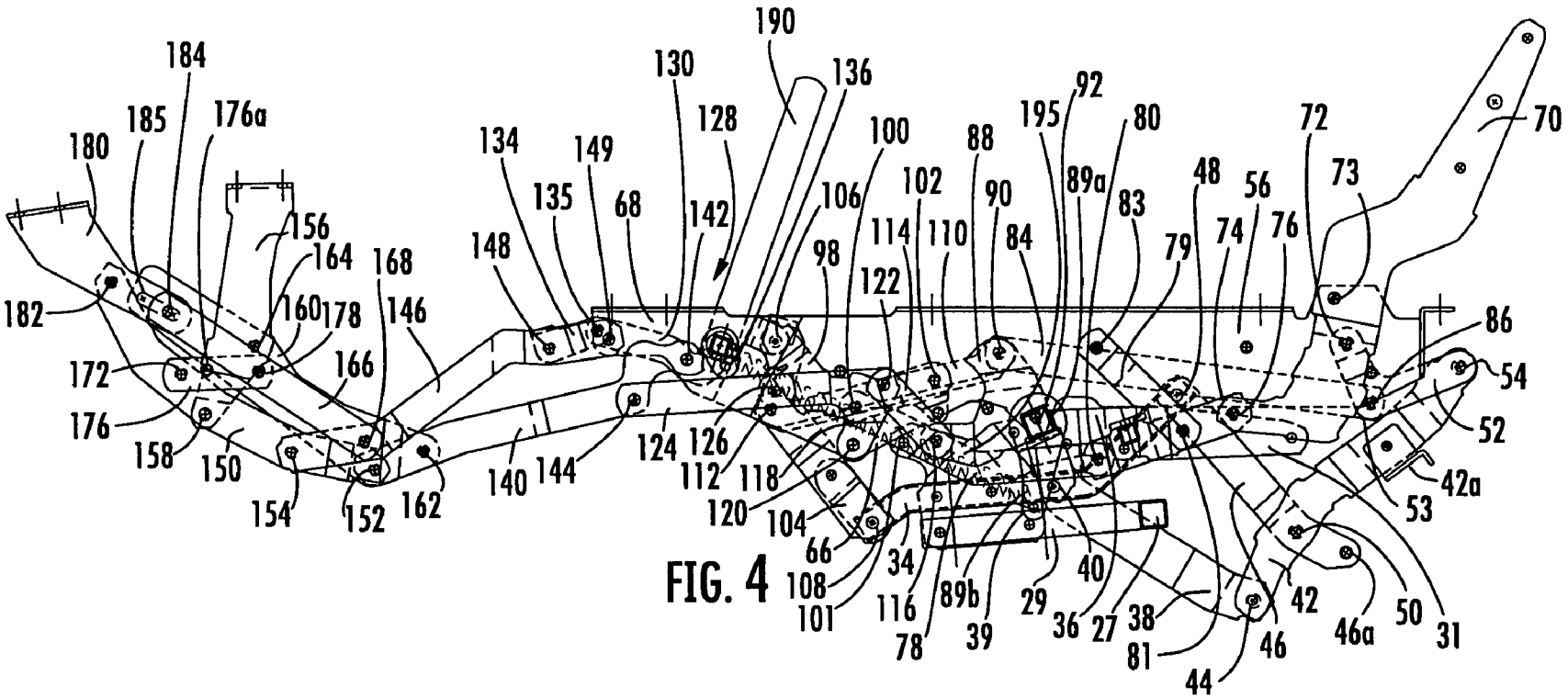
FIG. 4 is a side section view of the reclining mechanism of the chair of FIG. 1 shown in the TV position.

To move the chair 10 from the closed position of FIGS. 2 and 3 to the TV position shown in FIGS. 4 and 5, the occupant of the chair 10 pulls the handle 190 rearwardly. Actuation of the handle 190 rotates the drive link 130 and the cross tube 192 clockwise about the axis defined by the holes 194 (this description of the rotation of the drive link 130 and of all other links discussed below are from the vantage point of FIG. 3). Because the pivots 135, 148 and the axis of the cross-tube 192 are not in a locked over-center condition, the handle 190 can be moved relatively easily and smoothly (this motion is resisted slightly by the spring 195, which biases actuation linkage 128 toward the upright position). Rotation of the drive link 130 forces the reaction link 134 forward and rotates it clockwise about the pivot 135 until it is almost completely inverted from its original position. This movement of the reaction link 134 rotates the upper ottoman drive link 146 clockwise about the pivot 149 and extends it in front of the seat 24. Extension of the upper ottoman drive link 146 draws the outer ottoman extension link 150 forward. The forward movement of the outer ottoman extension link 150 pulls the rear end of the lower ottoman drive link 140 forward and rotates it about the pivot 142. Rotation of the lower ottoman drive link 140 pushes the guard 160 forward, which causes the outer ottoman bracket 156 to rotate clockwise about the pivot 158 and to move forward, thereby lifting the ottoman 28*b* to a position in front of the seat 24.

Also, the respective actions of the upper ottoman drive link 140 and the outer ottoman extension link 150 force the inner ottoman extension link 166 and the ottoman control link 176 forward (the ottoman control link 176 also rotates clockwise about the pivot 172). In turn, the inner ottoman bracket 180 is drawn forward and inverted. Consequently, the ottoman 28*a* is positioned in front of the ottoman 28*b*.

Simultaneously, actuation of the handle 190 causes the seat 24 to move forward in relation to the base assembly 12. As the lower ottoman drive link 140 pivots about the pivot 142, it pulls the actuation drawing link 124 forward. Movement of the actuation drawing link 124 forces the actuator transition link 118 to rotate counterclockwise about the pivot 120, which rotation in turn draws the plate connecting link 114 forward. The action of the plate connecting link 114 rotates the control plate 88 clockwise about the pivot 92. Also, the forward action of the plate connecting link 114 forces the seat mounting link 56 forward. The rotation and forward movement of the control plate 88 forces the lower swing link 104 to rotate counterclockwise about the pivot 108 via the flanged link 110; this movement is controlled by the upper swing link 98. The spring tab 89*b* rotates clockwise with the control plate 88 to a position in which the spring 195 biases the chair toward the TV position. Further, the forward movement of the control plate 88 forces the transition link 84 to move rearwardly relative to the seat mounting link 56. This movement forces the drawing link 52 to rotate counterclockwise about the pivot 72. The rotation of the drawing link 52 raises the rear end of the rear swing link 42 relative to the seat 24 with slight counterclockwise rotation about the pivot 44, and forces the support link 38 to rotate slightly clockwise about the pivot 40. As a result of these movements, the seat 24, being carried by the seat mounting link 56, moves about 2.5-5.0 inches forward and the rear end of the seat 24 descends approximately 1-3 inches relative to the base assembly 12.

As a consequence of the movements of the links described above, the chair 10 moves to the TV position shown in FIGS. 4 and 5, in which the ottomans 28*a*, 28*b* are positioned generally horizontally forward of the seat 24, and the angle between the seat 24 and the backrest 26 is substantially unchanged. Movement of the links ceases when the upper edge of the outer ottoman extension link 150 contacts the pin 176*a* on the ottoman control link 176 and when the pin 88*a* of the control plate 88 contacts the lower edge of the seat mounting link 56.

The relative proximity of the pivots 135, 149 can assist in controlling the force necessary to move the chair 10 to the TV position. As the chair 10 begins to move away from the upright position of FIGS. 2 and 3, the pivots 135, 149 are separated from one another. As a result, the force applied by the reaction link 134 on the upper ottoman drive link 146 (via the movement of the handle 190) is relatively high as a function of the force applied to the handle, and the occupant of the chair 10 can move the chair 10 relatively easily. Also, the relative rotation of the upper ottoman drive link 146 (and, in turn, the unfolding of the ottomans 28*a*, 28*b*) is relatively slow. As the chair 10 approaches the TV position, the pivots 135, 149 are closely adjacent to one another, which increases the force necessary to continue to move the upper ottoman link 146, but also increases the relative rotation of the upper ottoman drive link 146 about the pivot 149, such that the ottomans 28*a*, 28*b* are unfolded relatively quickly. The timing of this increase in force can coincide with the relative movement of the weight of the occupant; as the chair 10 moves toward the TV position, the weight of the occupant is forward and downward relative to the center of gravity of the chair 10, so the occupant's weight can assist in moving the chair to the TV position. These differences in force and ottoman travel rate may be desirable, particularly in chairs in which the available space below the chair is somewhat limited (as with a high leg chair).

In addition, the configuration of the linkage that extends the ottomans 28*a*, 28*b* can also be advantageous in certain embodiments of the invention. The ottoman 28*b* faces forwardly and serves as the front panel of the chair below the seat in the upright position. Because of the styling constraints of a high leg chair, the ottoman 28*b* is somewhat limited in its width (i.e., its height in the upright position); in many embodiments the ottoman 28*a* is considerably wider than the ottoman 28*b* in order to provide adequate support in the TV and fully reclined positions to the extended legs of an occupant of the chair 10. However, the ottoman 28*a* faces downwardly below the front end of the seat 24 in the upright position, and must be almost completely inverted and moved to a position in front of the ottoman 28*b* in the TV position without striking the floor despite its greater wdith. This movement can be accomplished with considerable forward movement of the outer ottoman extension link 150 relative to the inner ottoman extension link 166. This movement is controlled by the ottoman control link 176. The presence of the slot 185 in the inner ottoman extension link 166 enables the inner ottoman bracket 180 to rotate quickly about its pivot 182 with the outer ottoman extension link 150 after moving in front of the seat 24 without the need for additional links.

To move the chair 10 from the TV position to the fully reclined position of FIG. 5, the occupant applies a rearwardly-directed force to the backrest 26 (typically by pushing forward on the arms 22 while seated). Such a force drives the backrest 26 and the attached backpost 70 clockwise about the pivot 73. The drive link 74 is forced forwardly (its movement being controlled by the regulating link 79), thereby driving the rear end of the connecting link 78 forward. Movement of the connecting link 78 forces the upper swing link 98 to rotate counterclockwise about the pivot 102. The action of the upper swing link 98 drives the upper end of the lower swing link 104 down and forward as it rotates about the pivot 108; this movement is augmented by the flanged link 110, which rotates counterclockwise about the pivot 90. This movement drives the seat mounting link 56, and in turn the seat 24 and backrest 26, forward relative to the base mounting tube 32. The forward movement of the seat mounting link 56 also draws the drawing link 52 forward, which in turn draws the upper end of the rear swing link 42 downward as it rotates clockwise about the pivot 44. The support link 38 and the control link 46 also rotate clockwise about, respectively, the pivots 40, 48.

The motion of the seat 24 and backrest 26 ceases when the upper edge of the backpost 70 contacts the stop pin 56*a* on the seat mounting link 56 and the rear swing link 42 strikes the stop pin 46*a*. In the fully reclined position, the seat 24 has moved additionally forward relative to the base assembly 12 (typically between about 7 and 10 inches), and the backrest 26 defines a greater angle with the seat 24 than when in the TV position. In addition, in the illustrated embodiment the rear end of the seat mounting link 56 (and, in turn, the seat 24) has risen between about 1.0 and 4.0 inches. The ottomans 28*a*, 28*b* remain extended in front of the seat 24 (see FIG. 5).

It can be seen that the support link 38, the rear swing link 42 and the control link 50, which are all positioned above or approximately level with the lower end of the U-shaped tube 25 when the chair 10 is in the upright position in order to remain obscured from view, are free in the fully reclined position to rotate such that their lower ends are positioned well below the tube 25 (in particular, the pivots 44, 50 are well below the pivots 40, 48). These links act as an idler linkage that controls and raises the rear end of the seat 24 as the upper and lower swing links 98, 104 and flanged link 110 guide the seat 24 forwardly, driven by the connecting link 78 via the drive link 74.

Also, in the fully reclined position, much of the weight of the occupant is borne by the flanged link 110 (perhaps as much as 80 percent or more), which is substantially vertical in the fully reclined position. As such, the flanged link 110 may be prone to buckling. The presence of the flange 111 provides significant additional strength and rigidity to the flanged link 110, thereby enabling it to withstand the extreme load imposed thereon.

It can be seen from the foregoing that the mechanism 30 provides adequate extension of the ottomans 28*a*, 28*b* in front of the seat 24 without interfering with the floor or base 12, and that this is accomplished while still confining the mechanism in the closed position within the tight volume available in high-leg style chairs.

Those skilled in this art will appreciate that, although a chair having a stationary base and a one-piece arm frame attached thereto is illustrated and described herein, this mechanism and modifications thereof may also be suitable for use with other seating unit styles. For example, the mechanism may be employed with a chair in which the base swivels, or one in which the arms and seat move together. In such a chair, each of the base mounting tubes can be mounted directly to a base that rests on the floor, and the reclining mechanisms can be attached thereto.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined by the following claims.

That which is claimed is:

1. A reclining seating unit, comprising:

a base;

a generally horizontally disposed seat positioned above the base;

a generally upright backrest positioned above a rear portion of the seat;

an ottoman; and a reclining mechanism attached to the base, seat, backrest and ottoman, the reclining mechanism comprising a series of pivotally interconnected links and configured to move the chair between an upright position, in which the ottoman is positioned below the seat and the backrest and seat form a first angle, a TV position, in which the ottoman is generally horizontally disposed in front of the seat, the seat and backrest move forwardly relative to the base, and the backrest and seat substantially maintain the first angle, and a fully reclined position, in which the seat and backrest form a second angle that is greater than the first angle, and the seat moves further forwardly relative to the base;

wherein in the upright position, the links of the mechanism extend downwardly from the seat less than about 9 inches.

2. A reclining seating unit, comprising:

a base;

a generally horizontally disposed seat positioned above the base;

a generally upright backrest positioned above a rear portion of the seat;

a first ottoman; and a reclining mechanism attached to the base, seat, backrest and first ottoman, the reclining mechanism comprising a series of pivotally interconnected links and configured to move the chair between an upright position, in which the first ottoman is positioned below the seat and is generally horizontally disposed and the backrest and seat form a first angle, a TV position, in which the first ottoman is generally horizontally disposed in front of the seat, the seat and backrest move forwardly relative to the base, and the backrest and seat substantially maintain the first angle, and a fully reclined position, in which the seat and backrest form a second angle that is greater than the first angle, and the seat moves further forwardly relative to the base;

wherein the reclining mechanism includes:

first and second ottoman drive links pivotally interconnected with the seat;

an outer ottoman extension link pivotally interconnected with the first and second ottoman drive links;

an inner ottoman extension link pivotally interconnected with the second ottoman drive link;

an ottoman control link pivotally interconnected with the outer ottoman extension link and with the inner ottoman extension link; and an outer ottoman bracket on which is mounted the first ottoman, the outer ottoman bracket being pivotally and slidably interconnected with the inner ottoman extension link and pivotally interconnected with the outer ottoman extension link.

3. The seating unit defined in claim 2, wherein the reclining mechanism further comprises:

a guard link pivotally interconnected with the outer ottoman extension link and with the first ottoman drive link; and an inner ottoman bracket pivotally interconnected with the outer ottoman extension link and with the guard link, a second ottoman being mounted on the inner ottoman bracket, the second ottoman being generally vertically disposed when the seating unit is in the upright position, and being generally horizontally disposed rearward of the first ottoman when the chair is in the TV position.

4. A reclining seating unit, comprising:

a base;

a generally horizontally disposed seat positioned above the base;

a generally upright backrest positioned above a rear portion of the seat;

an ottoman; and a reclining mechanism attached to the base, seat, backrest and ottoman, the reclining mechanism comprising a series of pivotally interconnected links and configured to move the chair between an upright position, in which the ottoman is positioned below the seat and the backrest and seat form a first angle, a TV position, in which the ottoman is generally horizontally disposed in front of the seat, the seat and backrest move forwardly relative to the base, and the backrest and seat substantially maintain the first angle, and a frilly reclined position, in which the seat and backrest form a second angle that is greater than the first angle, and the seat moves further forwardly relative to the base;

wherein the reclining mechanism includes an actuation assembly, the actuation assembly including a handle rotatably mounted relative to the seat about a transverse axis, a drive link fixed relative to the handle, a reaction link pivotally attached to the drive link at a first pivot, the reclining mechanism further including a first ottoman drive link pivotally interconnected with the seat at a second pivot; and wherein in the TV position, the first and second pivots are closely adjacent to each other, with the first pivot positioned slightly forward of the second pivot.

5. The seating unit defined in claim 4, wherein the reclining mechanism further includes a second ottoman drive link pivotally interconnected with the seat, and wherein the second ottoman drive link includes an arcuate portion that cups the transverse axis from underneath when the seating unit is in the upright position.

6. The seating unit defined in claim 5, wherein the actuation assembly further includes a spring tab fixed relative to the handle, and the reclining mechanism further includes a spring member pivotally mounted with the seat, and a spring extending between the spring tab and the spring member, the spring being in tension in the upright and the TV positions.

7. The seating unit defined in claim 6, wherein the spring tab and spring member are configured such that the spring biases the seating unit toward the upright position when the seating unit is in the upright position, and such that the spring biases the seating unit toward the TV position when the seating unit is in the TV position.

8. A reclining seating unit, comprising:

a base;

a generally horizontally disposed seat positioned above the base;

a generally upright backrest positioned above a rear portion of the seat;

an ottoman; and a reclining mechanism attached to the base, seat, backrest and ottoman, the reclining mechanism comprising a series of pivotally interconnected links and configured to move the chair between an upright position, in which the ottoman is positioned below the seat and the backrest and seat form a first angle, a TV position, in which the ottoman is generally horizontally disposed in front of the seat, the seat and backrest move forwardly relative to the base, and the backrest and seat substantially maintain the first angle, and a fully reclined position, in which the seat and backrest form a second angle that is greater than the first angle, and the seat moves further forwardly relative to the base;

wherein the reclining mechanism further includes a support link pivotally interconnected to the base at a first pivot, a rear swing link pivotally interconnected to the support link at a second pivot, and a control link pivotally interconnected to the base at a third pivot and to the rear swing link at a fourth pivot; and wherein in the fully reclined position, the second and fourth pivots are positioned below the first and third pivots.

9. The seating unit defined in claim 8, wherein the backrest is mounted on a backpost pivotally interconnected with the seat, and wherein the backpost is pivotally interconnected with a drawing link that is also pivotally interconnected with the rear swing link.

10. A reclining seating unit, comprising:

a base;

a generally horizontally disposed seat positioned above the base;

a generally upright backrest positioned above a rear portion of the seat;

an ottoman; and a reclining mechanism attached to the base, seat, backrest and ottoman, the reclining mechanism comprising a series of pivotally interconnected links and configured to move the chair between an upright position, in which the ottoman is positioned below the seat and the backrest and seat form a first angle, a TV position, in which the ottoman is generally horizontally disposed in front of the seat, the seat and backrest move forwardly relative to the base, and the backrest and seat substantially maintain the first angle, and a fully reclined position, in which the seat and backrest form a second angle that is greater than the first angle, and the seat moves further forwardly relative to the base;

wherein the reclining mechanism further includes a backpost fixed to the backrest and pivotally interconnected with the seat, a drive link pivotally interconnected to the backpost, a regulating link pivotally connected to the drive link and with the seat, and a connecting link that is pivotally interconnected to the drive link and that is coupled with the remaining links of the reclining mechanism such that pivotal movement of the backrest to the seat when the chair moves from the TV position to the upright position drives the seat and backrest forward relative to the base.

* * * * *

UNITED STATES PATENT AND TRADEMARK OFFICE

CERTIFICATE OF CORRECTION

PATENT NO. : 7,357,450 B2
APPLICATION NO. : 11/378056
DATED : April 15, 2008
INVENTOR(S) : Rogers It is certified that error appears in the above-identified patent and that said Letters Patent is hereby corrected as shown below:

Column 13, Claim 4, Line 10: Please correct "frilly reclined"
To read -- fully reclined --

Signed and Sealed this

Eighth Day of July, 2008

JON W. DUDAS
*Director of the United States Patent and Trademark Office*